US005146048A

United States Patent [19]

Yutori et al.

[11] Patent Number: 5,146,048

[45] Date of Patent: Sep. 8, 1992

[54] COAXIAL CABLE HAVING THIN STRONG NOBLE METAL PLATED INNER CONDUCTOR

[75] Inventors: Toshiaki Yutori, Takasago; Shigenobu Ohtsu, Kobe, both of Japan

[73] Assignee: Kabushiki Kaisha Kobe Seiko Sho, Kobe, Japan

[21] Appl. No.: 719,629

[22] Filed: Jun. 24, 1991

[30] Foreign Application Priority Data

Jun. 26, 1990 [JP] Japan ..... 2-167304
Jun. 26, 1990 [JP] Japan ..... 2-167305
Jun. 26, 1990 [JP] Japan ..... 2-167306

[51] Int. Cl.[5] ..... H01B 7/34

[52] U.S. Cl. ..... 174/36; 174/102 R; 174/126.2

[58] Field of Search ..... 174/36, 102 R, 126.2, 174/126.4, 102.C, 109

[56] References Cited

U.S. PATENT DOCUMENTS

| | | | |
|---|---|---|---|
| 3,130,256 | 4/1964 | Mildner | 174/107 |
| 3,971,880 | 7/1976 | Harris | 174/36 |
| 4,352,134 | 9/1982 | Burns et al. | 174/126.2 |
| 4,408,089 | 10/1983 | Nixon | 174/36 X |
| 4,415,877 | 11/1983 | Takami et al. | 174/126.2 |
| 4,642,417 | 2/1987 | Ruthrof et al. | 174/36 |
| 4,822,950 | 4/1989 | Schmitt | 174/36 |

FOREIGN PATENT DOCUMENTS 1277175 6/1972 United Kingdom .

*Primary Examiner*—Morris H. Nimmo
*Attorney, Agent, or Firm*—Oblon, Spivak, McClelland, Maier & Neustadt

[57] ABSTRACT

A coaxial cable having an inner conductor including a very fine metal wire having a diameter of 120 μm or below and a tensile strength of 100 kg/mm$^2$ or above, and a plated noble metal layer coating the very fine metal wire, an insulating layer of an insulating material coating the inner conductor, an outer conductor coating the insulating layer, and a jacket coating the outer conductor. In forming the inner conductor, a metal wire is coated with a noble metal layer by plating, and then the metal wire coated with the noble metal layer is subjected to plastic working to reduce the diameter and to improve the structure of the noble metal layer, A high-frequency signal applied to the coaxial cable is transmitted through the noble metal layer of a satisfactory structure by skin effect without being disturbed. The very small diameter and very high tensile strength of the very fine metal wire of the inner conductor enables the coaxial cable to be formed in a very small diameter. Such performance and structure of the coaxial cable is advantageous in its application to electronic equipment including IC chip testers and high-speed electronic computer systems.

2 Claims, 2 Drawing Sheets

COAXIAL CABLE HAVING THIN STRONG NOBLE METAL PLATED INNER CONDUCTOR

BACKGROUND OF THE INVENTION

1. Field of the Invention

The present invention relates to a coaxial cable for transmitting high-frequency signals and, more particularly, to a coaxial cable incorporating improvements in the inner and outer conductors to enhance line speed and to increase cable density in closely arranging a plurality of coaxial cables.

2. Description of the Prior Art

The coaxial cable has been used in most cases for transmitting high-frequency signals because two lines of a simple parallel arrangement increase radiation energy. The coaxial cable, in general, comprises an inner conductor centered inside, an insulating layer coating the inner conductor, an outer conductor coating the insulating layer, and a jacket coating the outer conductor. The coaxial cable is used, for example, for interconnecting a tester for testing the functions of electronic parts, such as ICs and LCDs, and a signal generator that generates testing high-frequency signals. The frequencies of the testing high-frequency signals must be increased to increase the testing speed of such ICs and LCDs, and the density of coaxial cables must be increased to deal with testing electronic parts, such as ICs, having a high degree of integration.

Very fine coaxial cables having very fine inner conductors must be used to arrange the coaxial cables with a large cable density. However, in the conventional coaxial cable, increase in the fineness of the component Cu wire of the inner conductor deteriorates the surface roughness of the inner conductor and, consequently, the waveforms of the high-frequency signals are liable to be disturbed due to skin effect that causes high-frequency signals to be transmitted through the surface of the inner conductor. The disturbance in the waveforms of the high-frequency signals generates noise, which affect adversely the testing function of the tester. Such an adverse effect of the noise on the testing function of the tester increases with increase of the frequency of the testing high-frequency signals. Thus, the conventional coaxial cable is unable to meet both the requirements for the enhancement of testing speed and those for increasing cable density.

SUMMARY OF THE INVENTION

Accordingly, it is an object of the present invention to provide a coaxial cable capable of satisfactorily dealing with both the enhancement of testing speed and the increase of cable density.

According to one aspect of the present invention, there is provided a coaxial cable which includes an inner conductor formed by coating a very fine metal wire having a diameter of 120 μm or below and a tensile strength of 100 kg/mm$^2$ or above with a plated noble metal layer strained by plastic working, an insulating layer of an insulating material coating the plated noble metal layer, and a metallic outer conductor coating the insulating layer.

Advantages of the coaxial cable of such a construction in accordance with the present invention will be described hereinafter.

The use of the very fine metal wire having a diameter of 120 μm or below and a tensile strength of 100 kg/mm$^2$ or above as an inner conductor enables a coaxial cable to be formed in a very small diameter suitable for arrangement in a high cable density. The very fine metal wire may be a low-carbon two-phase steel wire, a piano wire or a stainless steel wire. As mentioned above, a very fine Cu wire having a large surface roughness is liable to disturb the waveform of a signal and there is a limit to the reduction of the diameter of a Cu wire because a Cu wire has a comparatively low tensile strength. The present invention employs the foregoing very fine metal wire to enable the high-density arrangement of coaxial cables.

The plated noble metal layer strained by plastic working and coating the very fine metal wire prevents disturbance in the waveform of a signal transmitted through the coaxial cable, so that a high-frequency signal having an increased frequency can be transmitted without being disturbed. The noble metal forming the plated noble metal layer may be Au, Ag or Pt. The plated noble metal layer prevents the disturbance of the waveform of a high-frequency signal attributable to skin effect. A plated noble metal layer as plated has a surface roughness not small enough for satisfactory performance. Plastic working of the plated noble metal layer improves the surface roughness of the plated noble metal layer remarkably because of the following reasons. A plated noble metal layer as plated has a porous structure having numerous pores. The pores stores hydrogen produced during the plating process or air, and the hydrogen or air stored in the pores adversely affect the surface roughness of the plated noble metal layer. The plastic working of the plated noble metal layer crushes the pores and heat generated by plastic working eliminates hydrogen or air stored in the pores, so that the plated noble metal layer finished by plastic working has a dense structure and a surface of an improved surface roughness. The plastic working of the plated noble metal layer can be achieved by cold-drawing a wire coated with a plated noble metal layer in manufacturing the very fine metal wire. Preferably, a plated Ni layer is formed between the very fine metal wire and the plated noble metal layer to enhance the adhesion of the plated noble metal layer to the very fine metal wire.

The insulating layer may be formed of a synthetic resin, such as Teflon, i.e., polytetrafluoroethylene. The outer conductor may be formed of Au or Cu. The outer conductor need not necessarily entilely coat the outer surface of the insulating layer, but may be of a meshed structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
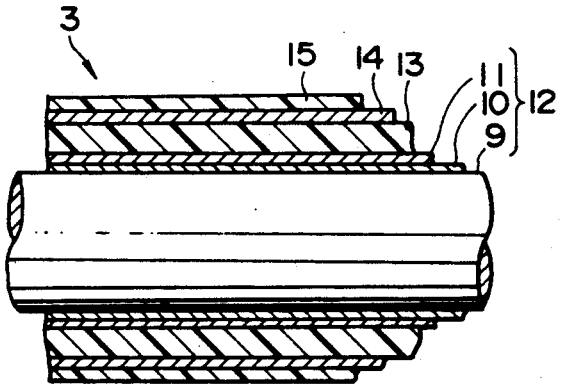
FIG. 1 is a longitudinal sectional view of a coaxial cable in a preferred embodiment according to the present invention.
Figure 2:
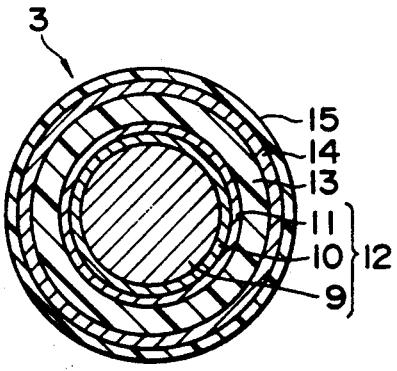
FIG. 2 is a cross-sectional view of the coaxial cable of FIG. 1.

Referring now to the drawings, wherein like reference numerals designate identical or corresponding parts throughout the several views, and more particularly to FIG. 1 thereof, a coaxial cable 3 embodying the present invention includes an inner conductor 12 consisting of a very fine metal wire 9, a plated Ni layer 10 as a ground layer coating the metal wire 9, and a plated Ag layer 11 coating the plated Ni layer 10, an insulating layer coating the inner conductor 12, an outer conductor 14 coating the insulating layer 13, and a jacket 15 coating the outer conductor 14.

The very fine metal wire 9 is a low-carbon two-phase steel wire of 120 μm or below in diameter. The low-carbon two-phase steel wire is manufactured by subjecting a wire containing 0.001 to 0.005% by weight C, 3.0% by weight or below Si, 5.0% by weight or below Mn, a balance of Fe and unavoidable impurities and having a diameter in the range of 3.0 to 6.0 mm to a primary heat treatment, a primary cold drawing, a secondary heat treatment and a secondary cold drawing. The very fine metal wire 9 thus manufactured has a dense fibrous structure consisting of fibrous cells formed by plastic working. The fibrous cells have a size in the range of 5 to 10 Å and the fibrous cells are arranged at intervals in the range of 50 to 1000 Å. The tensile strength of the very fine metal wire 9 is in the range of 300 to 600 kg/mm$^2$. The plated Ni layer 10 improves the adhesion of the plated Ag layer 11. Strain is induced in the plated Ni layer 10 and the plated Ag layer 11 by the plastic working. The plated Ni layer 10 and the plated Ag layer 11 are formed in a thickness on the order of 4 μm, and the thickness of the plated Ni layer 10 and the plated Ag layer 11 is reduced to a thickness on the order of 1 μm by the primary and secondary cold drawing. Pores formed in the plated Ni layer 10 as plated and in the plated Ag layer 11 as plated are crushed by the primary and secondary cold drawing to finish the plated Ni layer 10 and the plated Ag layer 11 in faultness, dense plated layers of satisfactory quality.

The insulating layer 13 is formed of an insulating synthetic resin, such as Teflon. The outer conductor 14 is a plated layer of Cu or Ag. The outer conductor 14 may be a meshed Cu sheet or a Cu pipe. The jacket 15 may be formed, for example, of the same material as that forming the insulating layer 13.

Since the plated Ag layer 11 is strained by plastic working, the adhesion of the insulating layer 13 to the plated Ag layer 11 is improved and the thickness of the insulating layer 13 is uniform with respect to the longitudinal direction. Thus, the impedance of the coaxial cable is constant with respect to the longitudinal direction, which improves the transmission characteristics of the coaxial cable.

The low-carbon two-phase steel having a very high tensile strength, forming the very fine metal wire 9 of the inner conductor 12 enables the very fine wire 9 to be formed in a very small diameter.

Application of coaxial cables embodying the present invention to an IC chip tester will be described hereinafter.

Figure 3:
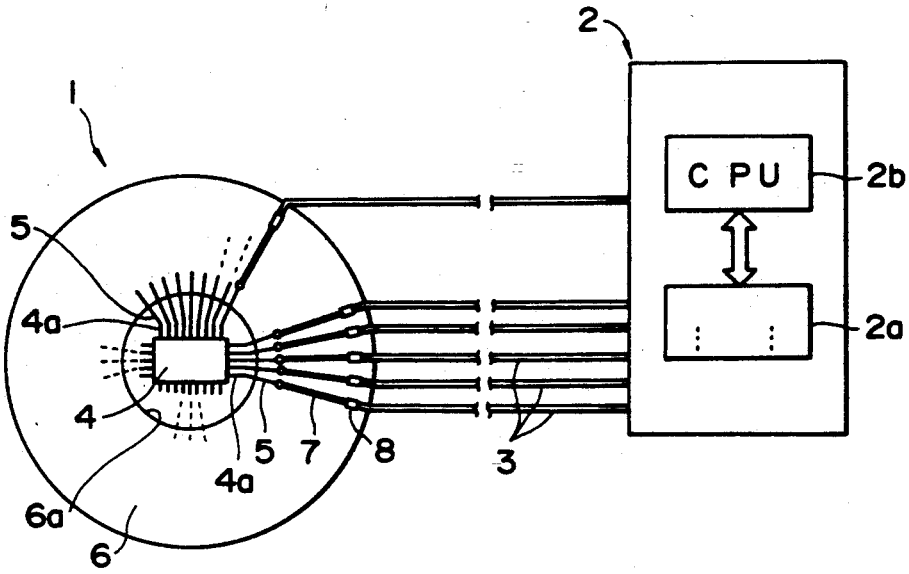
FIG. 3 is a schematic front view of an IC chip tester employing coaxial cables in accordance with the present invention.

Referring to FIG. 3, an IC chip tester includes a probe card 1, a control unit 2 for controlling testing operation to be carried out by the probe card 1, and coaxial cables 3 of the present invention interconnecting the probe card 1 and the control unit 2.

The control unit 2 includes a signal generator 2*a* for generating testing high-frequency signals, and a CPU 2*b* which controls the transmission and reception of signals and determines the functions of an IC chip 4, i.e., a specimen. The probe card 1 includes a substrate 6 provided with an opening 6*a* and having the shape of a disk, and probe pins 5*a* radially and fixedly arranged on the substrate 6 with their tips positioned on the edge of the opening 6*a*. The probe pins 5 are located so that their inner tips come into contact with the external terminals 4*a* of the IC chip 4 when the IC chip 4 is placed in the opening 6*a*. The outer ends of the probe pins 5 are connected to strips 7 formed in a pattern on the substrate 6. The outer ends of the strips 7 are connected to the coaxial cables 3 by connectors 8.

In operation, testing high-frequency signals of frequencies according to control signals provided by the CPU 2*b* are supplied through the coaxial cables 3, the strips 7 formed on the probe card 1 and the probe pins 5 to the IC chip 4 to test the functions of the IC chip 4. The testing high-frequency signals flow through the skins, i.e., the plated Ag layers 11, of the inner conductors 12. Since the skins are the smooth, dense, plated Ag layers 11 strained by plastic working and having no pore, the waveforms of the testing high-frequency signals are not disturbed.

Application of coaxial cables embodying the present invention to a high-speed electronic computer system, such as a super computer system, including a plurality of processors interconnected by coaxial cables will be described hereinafter.

Figure 4:
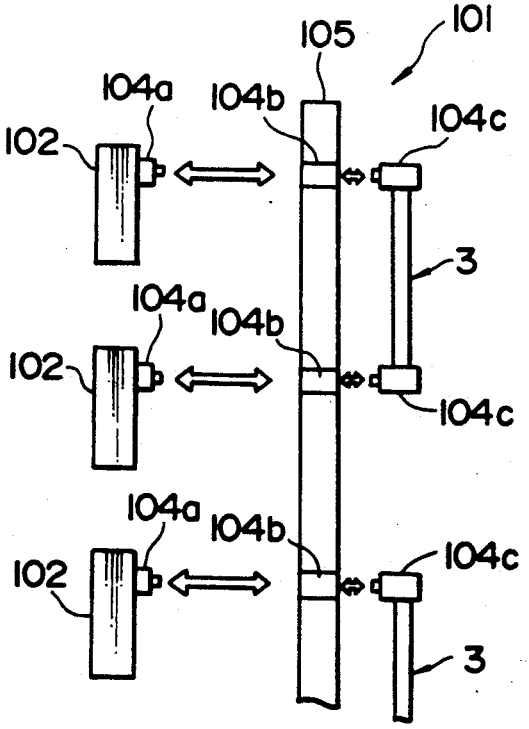
FIGS. 4 and 5 are conceptional diagrams of an electronic computer system.

Referring to FIG. 4, a high-speed electronic computer system 101 is constructed by connecting a plurality of processors 102 each including a circuit board provided with arithmetic circuits, control circuits and a main storage to a mother substrate 105 by means of connectors 104*a* and 104*b*, and interconnecting the processors 102 by means of the connectors 104*b*, connectors 104*c* and coaxial cables 3 of the present invention.

Figure 5:
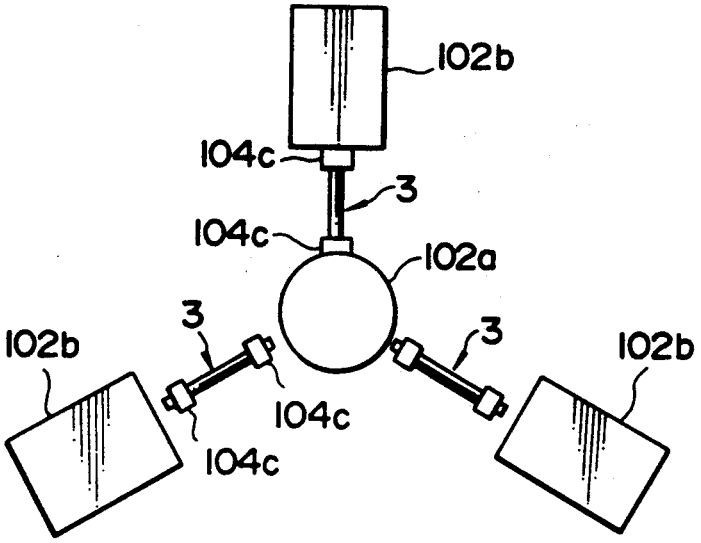

Referring to FIG. 5, another high-speed electronic computer system is constructed by connecting a plurality of auxiliary processors 102*b* to a main processor 102*a* by means of coaxial cables 3 of the present invention each provided at the opposite ends thereof with connectors 104*c*.

The coaxial cables 3 transmit high-frequency signals at a high signal transmission speed between the processors 102 and between the main processor 102*a* and the auxiliary processors 102*b* without disturbing the high-frequency signals.

Although the present invention has been described in its preferred form with a certain degree of particularity, obviously many changes and variations are possible therein. It is therefore to be understood that within the scope of the appended claims, the present invention may be practiced otherwise than as specifically described herein.

What is claimed as new and desired to be secured by Letter patent of the United States is:

1. A coaxial cable comprising:

an inner conductor including a very fine metal wire having a diameter of 120 μm or below and a tensile strength of 100 kg/mm$^2$ or above, and a plated noble metal layer coating the very fine metal wire, said inner conductor formed by subjecting a metal wire coated with a layer of the noble metal formed by plating to plastic working to strain the layer of the noble metal;

an insulating layer of an insulating material coating the inner conductor; and an outer conductor of a metal coating the insulating layer.

2. A coaxial cable according to claim 1, wherein a plated nickel layer is formed between the very fine metal wire and the plated noble metal layer.

* * * * *